US005584137A

United States Patent [19]

Teetzel

[11] Patent Number: 5,584,137

[45] Date of Patent: Dec. 17, 1996

[54] MODULAR LASER APPARATUS

[76] Inventor: James W. Teetzel, 14 Stratham Green, Stratham, N.H. 03885

[21] Appl. No.: 303,860

[22] Filed: Sep. 9, 1994

Related U.S. Application Data

[63] Continuation-in-part of Ser. No. 200,204, Jul. 23, 1994, Pat. No. 5,481,819, which is a continuation-in-part of Ser. No. 89,889, Jul. 12, 1993, Pat. No. 5,425,299, which is a continuation-in-part of Ser. No. 73,766, Jun. 8, 1993, Pat. No. 5,355,608.

[51] Int. Cl.[6] ..... F41G 1/35; F41G 1/36

[52] U.S. Cl. ..... 42/103; 362/114

[58] Field of Search ..... 42/103; 362/110, 362/113, 114

[56] References Cited

U.S. PATENT DOCUMENTS

| | | | |
|---|---|---|---|
| 1,262,270 | 4/1918 | Schmidt et al. | 362/110 |
| 2,101,479 | 12/1937 | Schenk | 362/110 |
| 4,939,863 | 7/1990 | Alexander et al. | 42/103 |
| 5,033,219 | 7/1991 | Johnson et al. | 42/103 |
| 5,052,138 | 10/1991 | Crain | 42/1.02 |
| 5,142,805 | 9/1992 | Horne et al. | 42/1.02 |

FOREIGN PATENT DOCUMENTS

| | | | |
|---|---|---|---|
| 3325755 | 1/1985 | Germany | 42/103 |
| 2052025 | 1/1981 | United Kingdom | 362/113 |

*Primary Examiner*—Stephen M. Johnson
*Attorney, Agent, or Firm*—William B. Ritchie

[57] ABSTRACT

A laser sight that can be fits conventional handguns and rifles without requiring major modification of the weapons and yet fits within the profile of the weapons framework. The invention features a chassis containing an infrared and visible red laser than can be mounted in various position, depending on the weapon selected. For a 9 mm handgun, the chassis mounts on the front face of the muzzle. For a M-16, the chassis mounts on the weapon handle. The weapons factory installed hand grips are replaced by modified hand grips that contain the laser electronic controls, water proof activation switches, and power source. The hand grips are wired to the chassis via a flexible internal circuit tape in the case of the 9mm and waterproof quick disconnect cable for the M-16. The apparatus is designed to be used with commercially available batteries providing about 12 hours of operating time.

6 Claims, 12 Drawing Sheets

MODULAR LASER APPARATUS

This application is a continuation-in-part of U.S. patent application Ser. No. 08/200,204, filed Jul. 23, 1994, now U.S. Pat. No. 5,481,819, which is a continuation-in-part of U.S. patent application Ser. No. 08/089,889, filed Jul. 12, 1993, now U.S. Pat. No. 5,425,299, which is a continuation-in-part of U.S. patent application Ser. No. 08/073,766, filed Jun. 8, 1993, now U.S. Pat. No. 5,355,608.

BACKGROUND OF THE INVENTION

1. Field of the Invention

The invention relates to laser sights for use on small firearms, particularly semiautomatic handguns and rifles.

2. Description of the Related Art

It is well known that even skilled marksman with a handgun have been unable to hit a target as close as 7 meters when attempting to draw the weapon and fire at speed. In target shooting, the shooter must obtaining the proper stance by carefully positioning the feet and the "free" hand to find the most stable condition, producing no muscular strain that will adversely effect the accuracy of the shot. Most importantly, the shooter must be able to obtain an identical position each time the weapon is fired to achieve the greatest accuracy. As the whole upper torso moves during each breath, breath control plays a vital role in the process. Since there can be no body movement at the time the trigger is fired, obviously the act of breathing must be stopped during the time the weapon is aimed and fired.

Sight picture and aim are critical if the shooter is to fire the most accurate shot or series of shots. When a mechanical pistol sight is properly aligned, the top of the front sight should be level with the top of the rear sight, with an equal amount of light on either side of the front sight. Using this sight picture requires that the shooter focus his shooting eye-so that the sights are in focus and the target is out of focus. Added to the difficulty, the trigger, all of the above must be maintained while the trigger is released using direct, even pressure to keep the barrel of the gun pointing at the target. These skills require tremendous practice, with each shot fired needing the utmost concentration if the shooter is to obtain maximum accuracy.

It is clear that the recommended methods of achieving maximum shooting accuracy useful for target shooting, must be severely modified when a handgun is used in a law enforcement situation. While the degree of accuracy necessary for target shooting and the distances and substantial lower, accuracy is still vital. Law enforcement official are instructed to fire only as a last resort, cognizant of the fact that their intended target will mostly be killed. Shooting to wound occurs only in the movies. Law enforcement officers typically use higher caliber handguns, mostly 9 mm, which are designed to immobilize with a single shot if that shot strikes a vital area. Given the inherent inaccuracies in the shooting process itself, exacerbated by the stress and fear of the police officer in what may be a life threatening situation for him/her, the exact location of the bullet where millimeters can mean the difference between death and survival cannot be known a priori by the even the most skilled marksman.

Mechanical sights have limited value in many situation where an officer must quickly draw his gun, perhaps while moving, and fire at a close target without sufficient time to properly obtain a sight picture. Under these circumstances, instinctive aiming, that is, not using the sights but rather "feeling where the gun barrel is pointing using the positioning of the hand holding the gun, is the preferred method. While this method, akin to the typical television cowboy shootouts, can be reasonably effective at short distances, obviously large errors in aiming are easily introduced, especially when the officer must frequently fire his/her weapon from a different hand position that has been used for practice. For example, bullet proof shields are used to protect the officer from being fired upon such as in a riot situation. In those circumstance, the officer must reach around his/her shield or other barricade and instinctively aim and fire his/her gun with the handgun in a very different orientation that would be experience if fired from a standing, drawn from a holster position. Small changes in barrel orientation due to the sight radius of the typical law enforcement handgun can produce substantial errors relative to the target. Accurate instinctive shooting is not considered practical beyond 20 feet for the average shooter.

The same problems face a soldier in a combat situation. While a rifle is inherently more accurate that a handgun, the stress of combat, the need to fire rapidly but accurately in order to survive is sufficient to introduce substantial errors into the sighting process. These problems are further exacerbated by the fact that most military personnel do not have sufficient practice time with their weapon to develop a high proficiency, particular in combat simulated situations.

An additional problem encountered in the military situation is the need for a sighting system that can be easily moved from one weapon to another. As warfare increases in sophistication, the need for more versatile armament increases correspondingly. Ideally, an operator should be able to quickly and confidently move the sighting system from one weapon to another without needing any field adjustments.

A solution to this problem for handguns has been the introduction of laser sights. The typical laser sight is mounted on the top on the handgun or on the bottom. The laser sight when properly aligned, places a red light dot on the target where the bullet will strike if the gun is fired. Using this type of sight, enables the law officer to rapidly instinctively properly position the weapon and be certain of his/her intended target. Using a laser sight enables accurate shots to be fired at distances of more than 50 feet, sufficient for most combat law enforcement situations requiring the use of handguns.

U.S. Pat. No. 4,934,086, issued to Houde-Walter on Jun. 19, 1990, discloses installing the laser sight within the recoil spring guide. The use of the recoil spring guide to house the laser sight components enables the firearm to be holstered in a normal manner. The use of the spring recoil guide presents alignment problems to ensure accuracy. In other words, the laser within the recoil guide is difficult to align with the barrel of the firearm. Therefore, misalignment of the sight resulting in poor accuracy is likely.

However, prior art laser devices have several disadvantages. As they are mounted either on the top or the bottom of the weapon, the balance of the gun is disturbed which makes it more difficult for the shooter to rapidly use his/her instinctive sighting technique to move gun into alignment for hitting the desired target. Also, since prior art laser sights are very bulky in comparison to traditional mechanical sights, the weapon cannot be used in a standard holster. Further, the laser sight is extremely vulnerable to being hit due to extending substantially beyond the normal profile of the weapon and thereby misalignment of the sight and defeating the advantages offered by the laser sight. A laser sight capable of being installed in a semi-automatic handgun, easily and accurately adjustable, is not disclosed in the prior art.

A laser sight for a standard military issue weapon such as the M-16 that can be attached to the weapon without requiring a major modification of the firearm is not available. Use of the type of laser sights discussed below for handguns will also exhibit the same type of problems relative to installation on an M-16.

Prior art laser devices have several disadvantages. As they are mounted either on the top or the bottom of the weapon, the balance of the gun is disturbed which makes it more difficult for the shooter to rapidly use his/her instinctive sighting technique to move gun into alignment for hitting the desired target. The particular design of the M-16, having a carrying handle on the top of the firearm, makes adding a prior art laser devices to this weapon impractical. Also, since prior art laser sights are very bulky in comparison to traditional mechanical sights, when used with a handgun, the weapon cannot be used in a standard holster. Further, the laser sight is extremely vulnerable to being hit due to extending substantially beyond the normal profile of the weapon and thereby misalignment of the sight and defeating the advantages offered by the laser sight. A laser sight capable of being installed in a semi-automatic handgun or on a military rifle such as an M-16, easily and accurately adjustable, and moveable from one weapon to another without the need for field adjustments is not disclosed in the prior art.

SUMMARY OF THE INVENTION

It is an object of the invention to provide a laser module sight apparatus that can substantially fits within the profile of the weapon that the module is to be installed upon.

It is another object of the invention to provide a laser module sight apparatus that can be retro-fitted to standard semi-automatic handguns or to standard military rifles such as an M-16.

It is still another object of the invention to provide a laser module sight apparatus that can be easily moved from one weapon to another without the need for to align the laser located in the module.

It is still another object of the invention to provide a laser module sight apparatus that can be fitted to various semi-automatic handguns and military rifles requiring a minimum replacement of standard parts.

It is another object of the invention to provide a laser module sight apparatus that can easily adjusted by the user to permit accurately alignment of the laser sight with the barrel of the gun.

It is another object of the invention to provide a laser module sight apparatus that can be inexpensively produced using primarily commercially available parts.

It is another object of the invention to provide a laser module sight apparatus that can incorporate an infrared diode that makes the dot invisible to the naked eye, but clearly visible using standard night vision equipment.

It is still another object of the invention to provide a laser module sight that includes a removable flashlight module, incorporating both infrared and visible light.

It is another object of the invention to provide a laser module sight apparatus that is extremely light compared to existing lasers and their mounts.

It is still another object of the invention to provide a laser module sight apparatus that can be controlled using an easily operated keypad.

It is another object of the invention to provide a laser module sight apparatus that can be powered by commercially available batteries, providing at least several hours of service time before needing to be changed.

It is another object of the invention to provide a laser module sight apparatus that will incorporate a delay when the frame mounted switch is deactivated before the laser is turned off, thus permitting time for the user to activate the trigger switch without losing sight on the target.

It is another object of the invention to provide a laser module sight apparatus that will provide an adjustable pulse rate so that "friendly" laser beams can be distinguished from a laser beam from an enemy.

It is another object of the invention to provide a laser module sight apparatus that eliminates the need for a pressure pad on the grip handle which is awkward when holding the gun and requires adjustments to the shooter's grip to keep the laser off while maintaining stability.

The invention is a laser sight module for a firearm. A chassis mountable on said firearm is provided. A laser module, releasably attachable to said chassis, said laser module having a front face with at least one laser device housed within said chassis is provided. The light form said laser device exiting the front face of said chassis. A flashlight module, releasably attachable to said laser module, is provided. Said flashlight module has a front with at least one light source housed within said flashlight module. The light from said light source exits the front face of said flashlight module. Control means for controlling the operation of said laser module and said flashlight module is provided. Connection means for communication between said flashlight module and said laser module is provided such that a signal from an operator indicating said light source of said flashlight module is to be activated is communicated to said flashlight module from said laser module. Adjustment means connected between said chassis and said laser module is provided. Said adjustment means aligns said chassis with the barrel of said firearm, wherein said laser module can be easily moved to a different weapon so equipped without the need for additional adjustments to ensure that said laser module will accurately sight on a target.

DETAILED DESCRIPTION OF THE INVENTION

Figure 1:
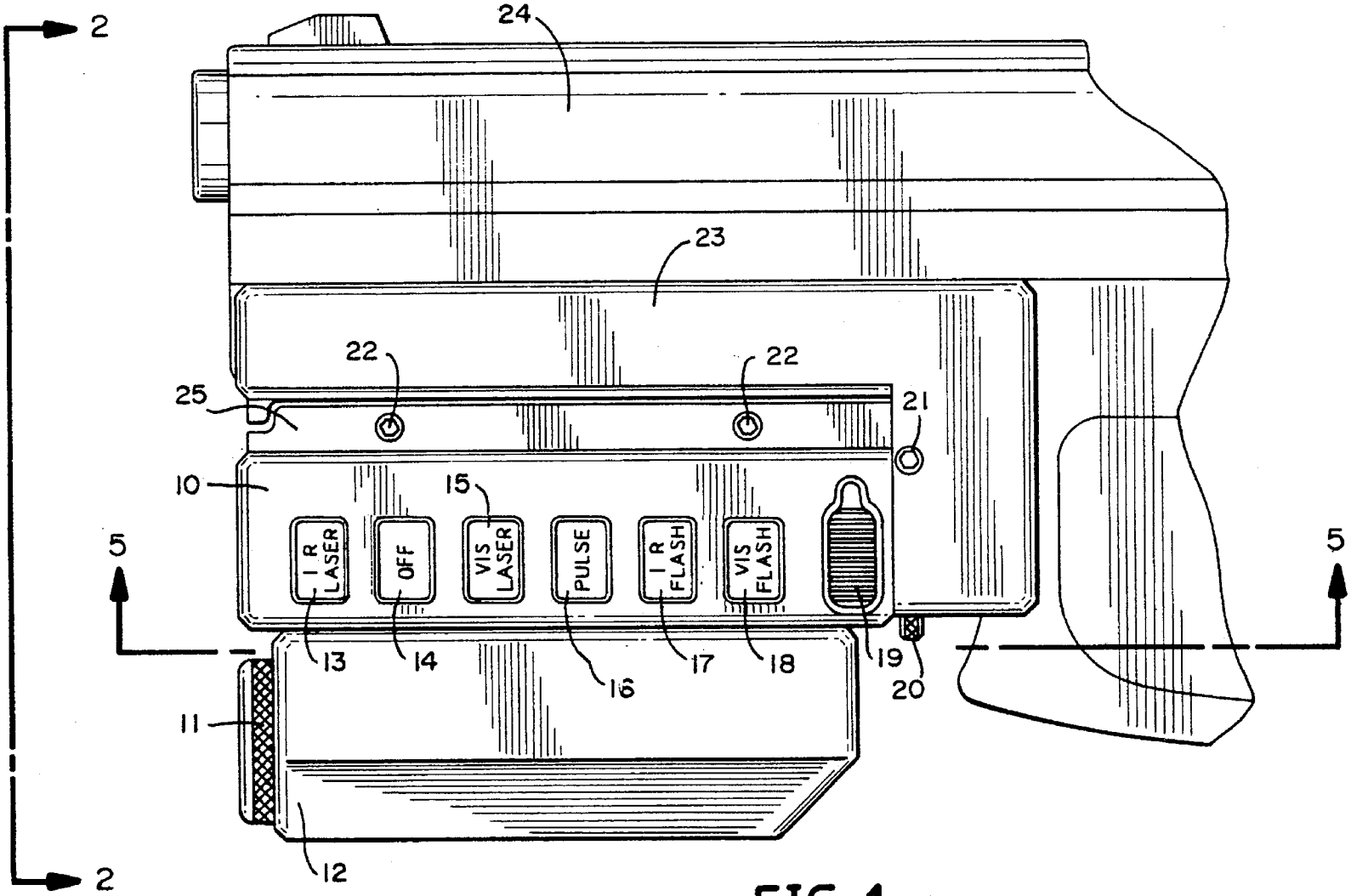
FIG. 1 is a side view of the modular laser apparatus mounted on a typical handgun.

The invention is a modular laser sighting system adaptable to the offensive handgun, as well as M4A1, M16, SMAW-D and other small arms. As shown in FIG. 1, laser module 10 attaches to weapon 24 via interface chassis 23 which allows the operator to quickly move module 10 from one weapon platform to another.

Figure 3:
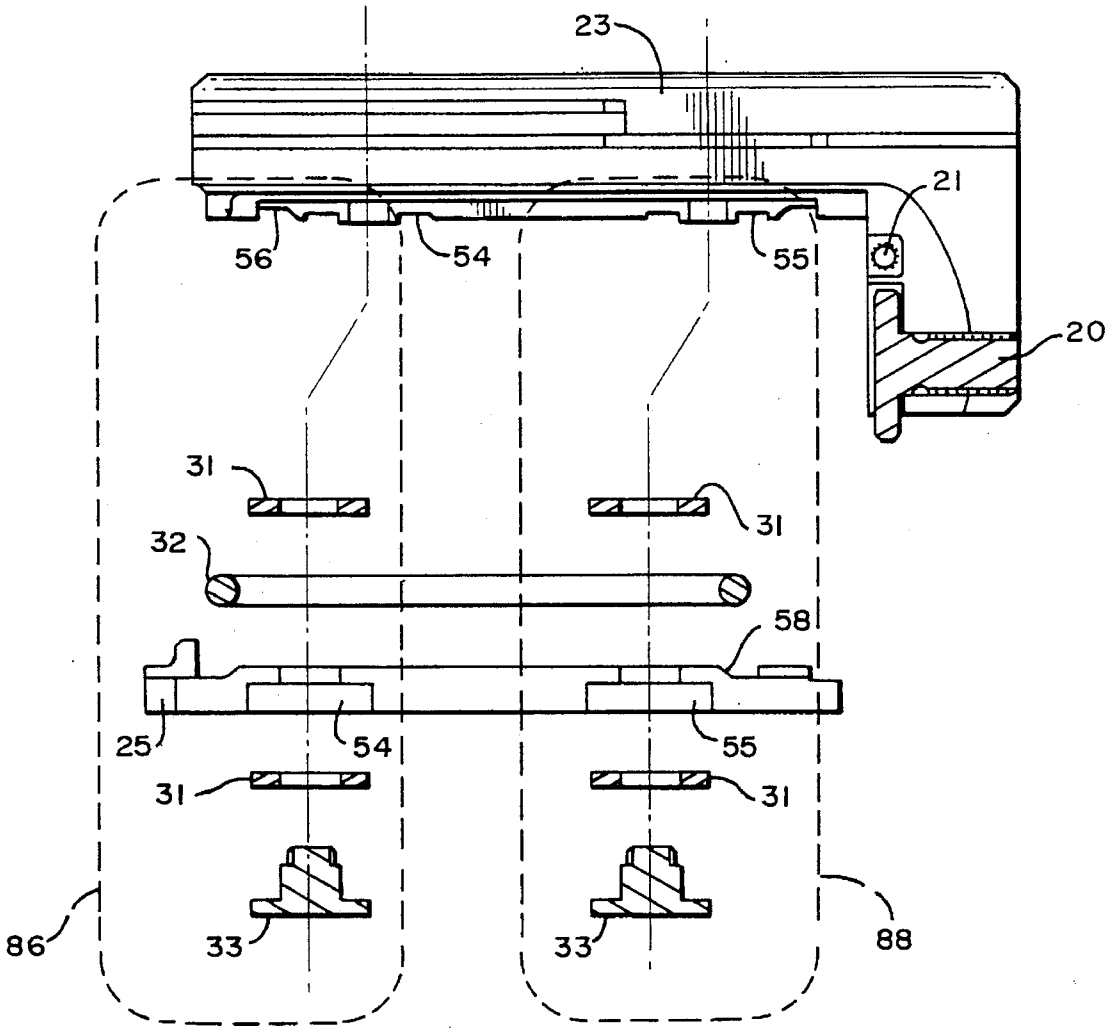
FIG. 3 is a partial exploded view along section line BB of FIG. 2.
Figure 3A:
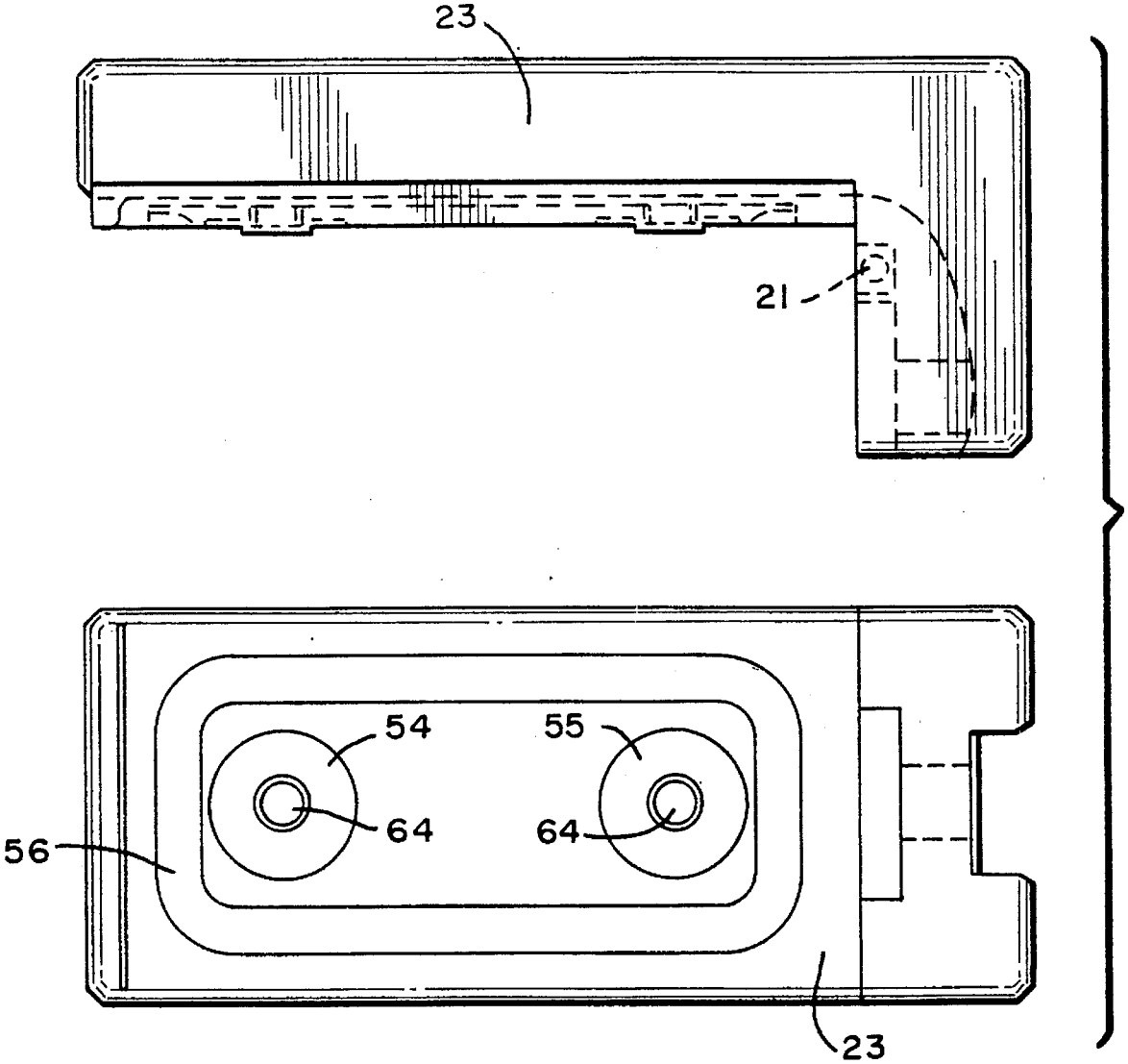
FIGS. 3A–3C are more detailed views of parts of FIG.3.
Figure 3B:
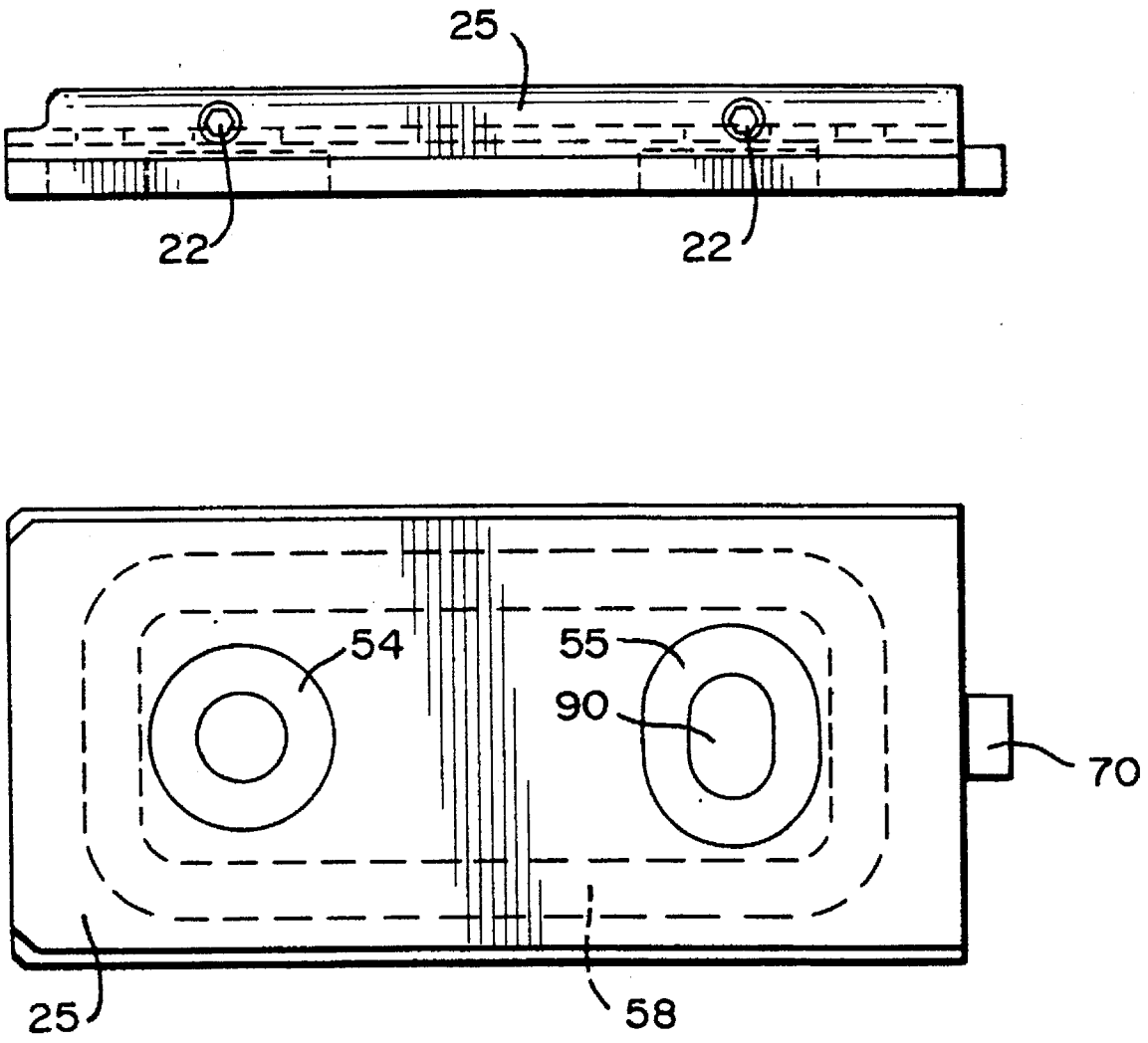
Figure 3C:
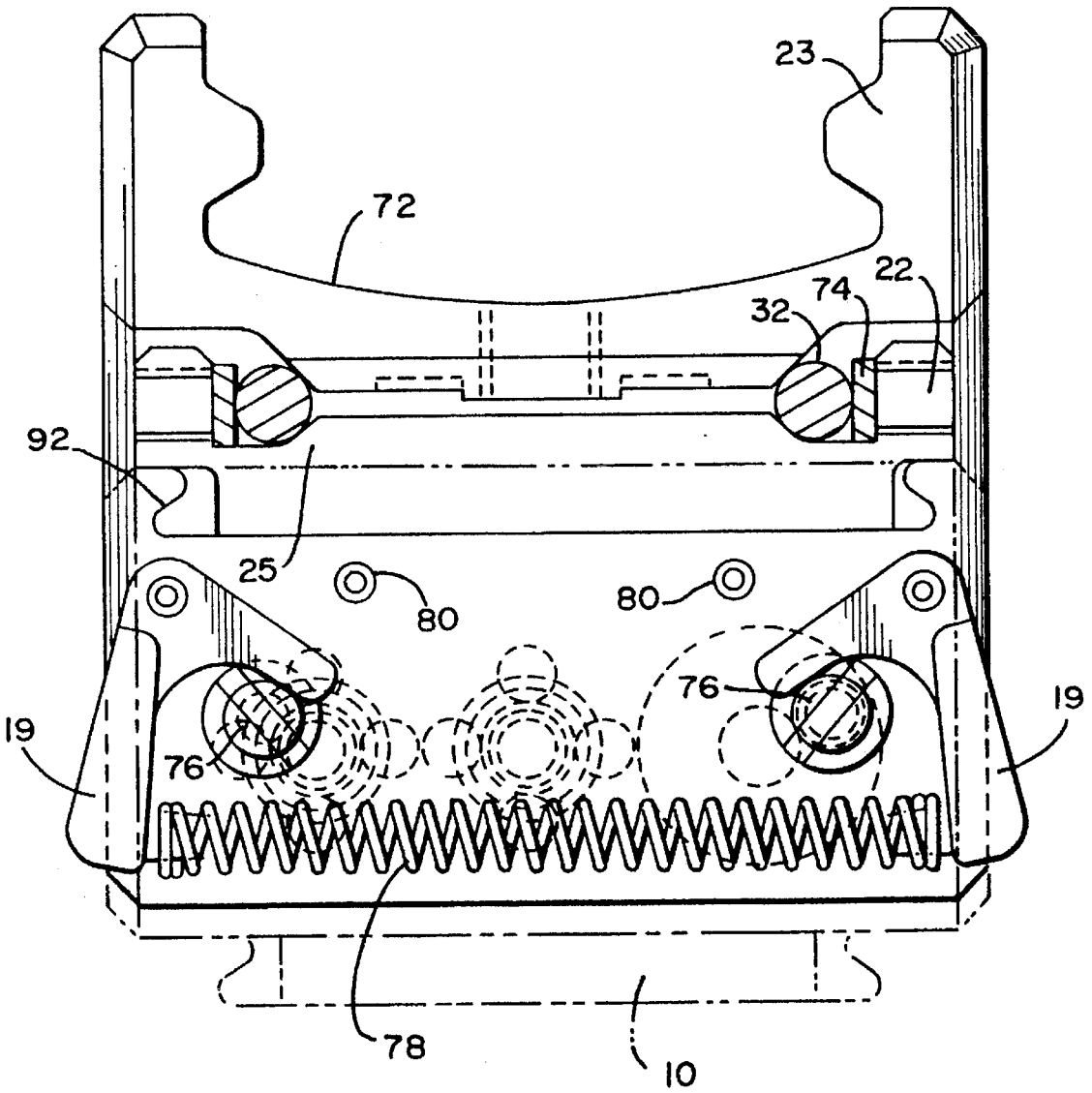
Figure 4:
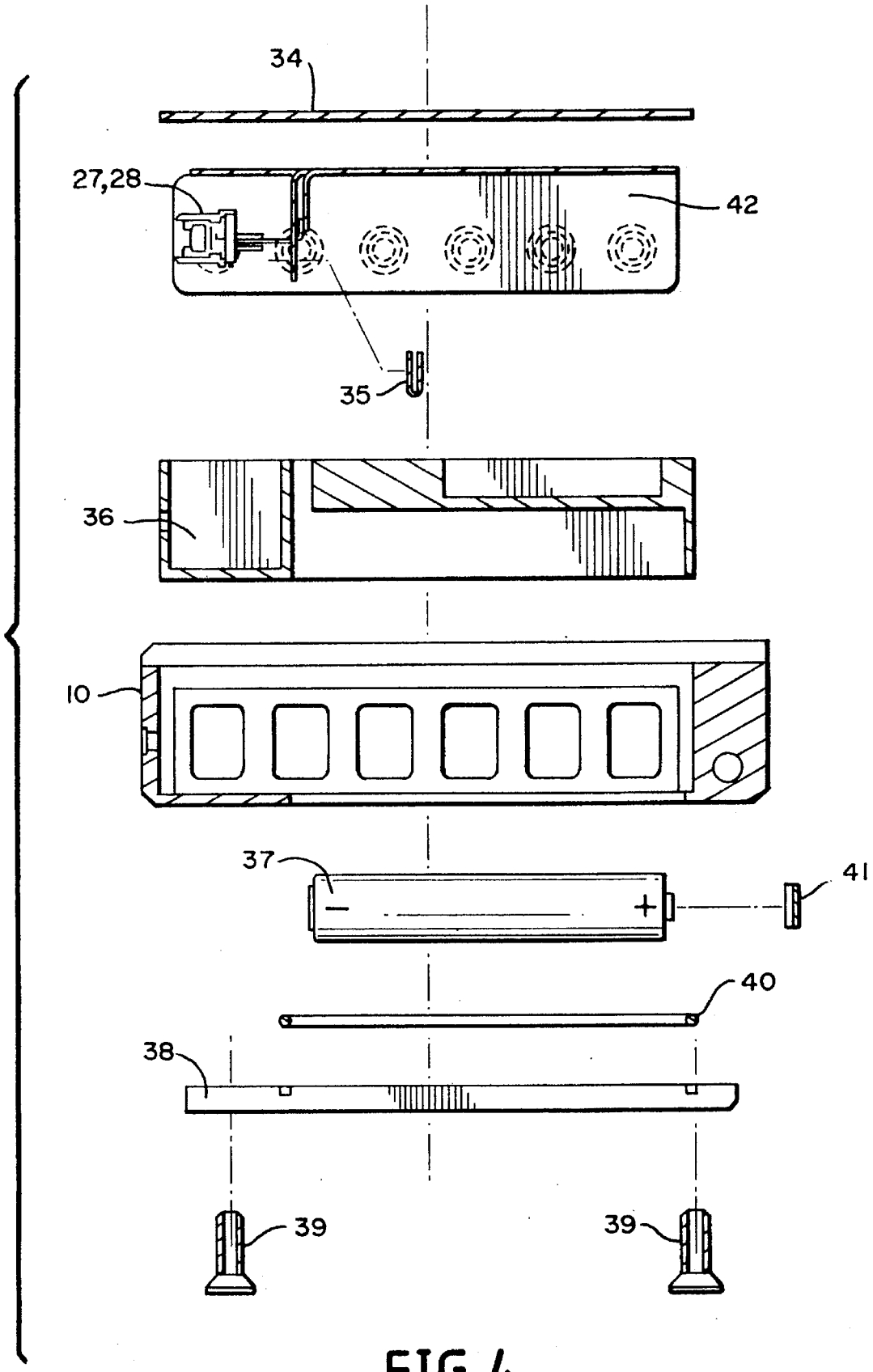
FIG. 4 is a partial exploded view along section line BB of FIG. 2.

Common leveling subplate assembly 84 (described in FIG. 3) is situated between interface chassis 23 and laser module 10 allows the system to be moved from one weapon to the next without needing any field adjustments to align laser located in the laser module, the flashlight module and, in the case of the M16/M4A1, in the handlegrips. Laser module 10 provides effective sighting of targets from 400–700 yards with both an infrared and visible laser.

Laser module 10 contains six control buttons for preselecting the following features: choice of visible, button 15 or infrared laser, button 13; choice of visible, button 18 or infrared flashlight illuminator, button 17; use of corresponding flashlight and laser together, with the laser dot at the center of the flashlight beam in either visible or infrared; and an adjustable laser beam pulse rate, button 16. Flashlight illuminator 12 is a separate unit with an independent power source which can be released from laser module 10. Wireless infrared remote control 43 (shown in FIG. 5) located on laser module 10 turns the power source for flashlight module 12 on and off. Flashlight module 12 can also be activated independently of laser module 10 for use in map reading, etc.

With laser module 10 attached without flashlight module 12, the offensive handgun 24 can be carried in a standard holster.

Six colored preselect buttons, identified above are inlaid into laser module 10. Buttons 13–18 are individually marked for easy identification of the function. The "IR LASER" and "VIS LASER", buttons 17 and 18, are for preselecting the infrared and visible red lasers respectively. The "OFF" button 14 shuts down the unit. The "IR FLASH" button 17 and "VIS FLASH" button 18 are for preselecting and the infrared and visible flashlight illuminators respectively and serve to activate flashlight module 12 power source when attached. To use a laser dot in conjunction with the corresponding flashlight, the operator depresses both the laser and illuminator preselect buttons.

"PULSE" button 16 is for programming the pulse rate of the laser beams. This feature allows the modification of both the infrared and red lasers from a constant beam to as few as 20 pulses per minute. Multiple shooters can distinguish their individual laser beams when jointly targeting the same area. During a forced entry or room sweep, individual shooters can identify their respective targets without the added confusion of trying to discern multiple laser beams.

Figure 6:
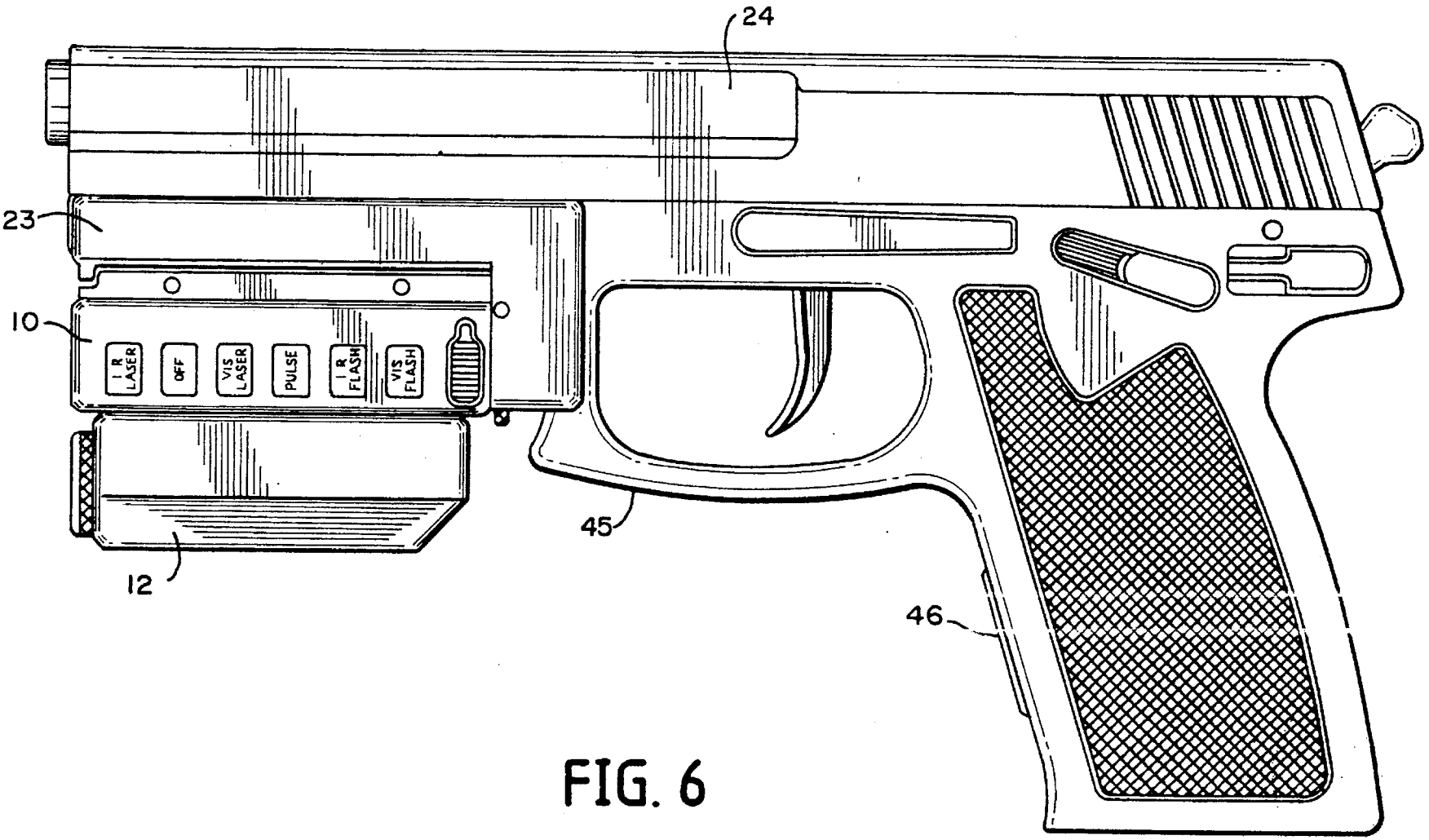
FIG. 6 is a side view of the modular laser apparatus mounted on a typical handgun.

Laser/flashlight activation is only possible when the visible or the infrared laser button or the visible or infrared flashlight button has been preselected. To activate the selected beam, the shooter depresses the activation buttons. Pressure on the activation buttons sends an infrared signal to laser module 10, activating the preselected features. The ambidextrous design allows activation by either the right or left hand. On offensive handgun 24, activation button 46 (shown in FIG. 6) is a pressure pad located below trigger guard. The activation signal is then carried via Kapton flex routing 45 to interface chassis 23. Chassis 23 has connectors 80 that connect to routing cable 45 so that laser module 10 can be turned on.

The location of the activation buttons will vary according to the particular weapon. For the M16/M4A1, the activation buttons are conveniently housed in the weapon handlegrip, ergonomically designed to accommodate the average grip. The activation switch on the SMAW-D is located on the back of the laser module.

The invention utilizes a 635 nm laser diode for visual sighting and an 830 nm laser for use with night vision equipment. Appropriate warning labels regarding laser danger are inlaid on the chassis to comply with federal regulations.

The effective range of a traditional open sight targeting system decreases dramatically in direct proportion to diminishing daylight. Targeting with a weapon equipped with the invention actually improves as darkness approaches. The bullet will hit the area illuminated by the laser dot, so there is no need to sight down the weapon or estimate the target. Laser aiming devises have been proven accurate for bullet placement in crowded areas and for multiple target acquisition. The invention allows the shooter to effectively fire the weapon from around most obstacles without becoming vulnerable to enemy fire.

The invention is powered by commercially available batteries, with 2 "AAAA" batteries located in the weapon grips for a rifle adaptation, 2 "AAAA" batteries in laser module 10, and 2 "AAA" batteries housed in flashlight module 12. The power sources provide up to 10 hours of continuous laser action and approximately several hours of continuous flashlight use. Battery life may be tested by depressing a sequence of buttons. If good, the red laser will emit a constant beam. A blinking beam indicates batteries are low and should be replaced. The battery test is independent of any beam pulse rates which the shooter may have programmed.

Figure 2:
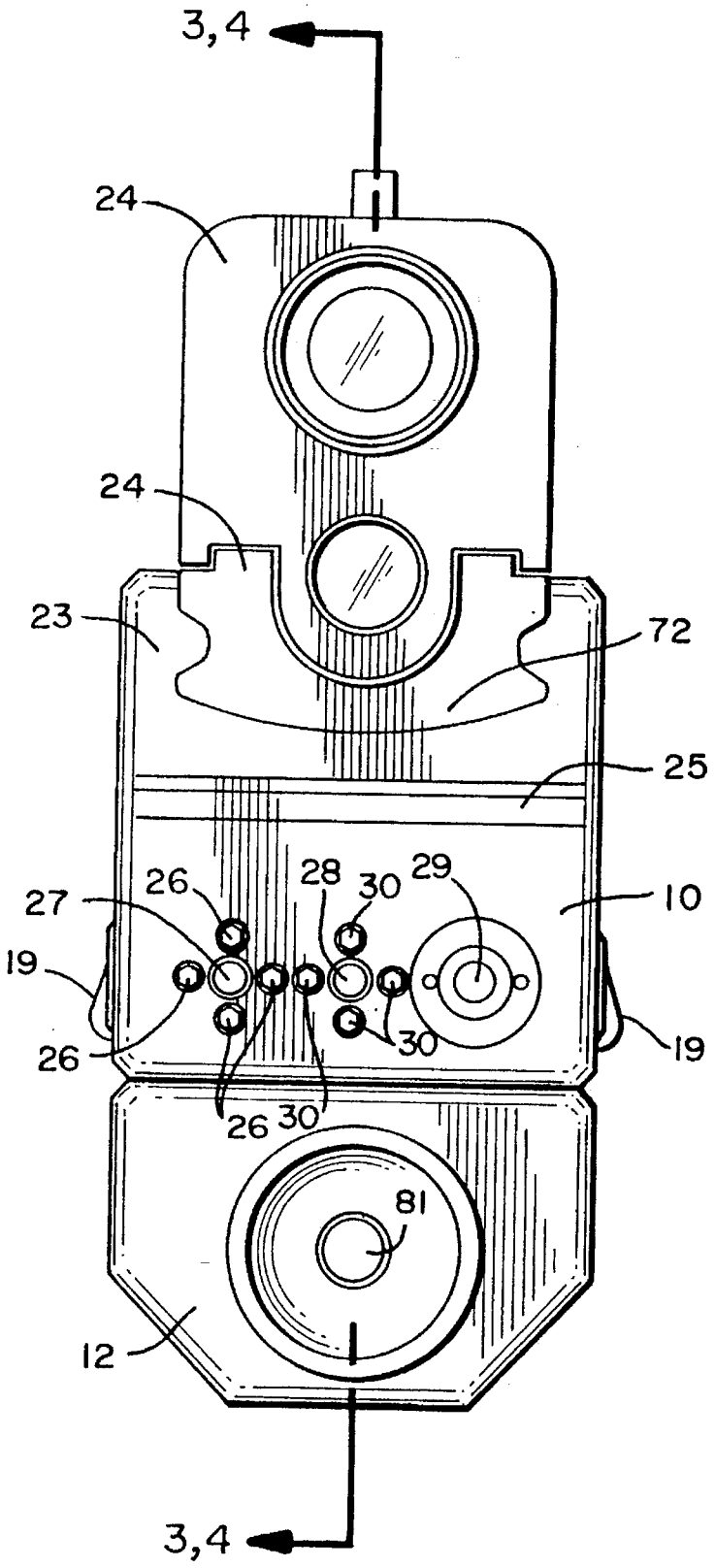
FIG. 2 is a front view of the modular laser apparatus mounted on a typical handgun along section line AA of FIG. 1.

FIG. 2 is a front view of modular,laser apparatus mounted on a typical handgun along section line AA of FIG. 1. Chassis 23 is shown attached to weapon 24. Note that surface contour 72 of chassis 23 is dimensioned to fit the profile of the weapon. When chassis 23 is mounted on a different weapon, surface contour 72 or other aspects of the geometry of chassis 23 may change, however, the adjustment features described herein will be same of every version. In this manner, laser module 10 and its attached flashlight module 12 can be moved from weapon to weapon without requiring additional adjustments to sight in the weapon. As shown, infrared flashlight 29 is located on laser module 10 and visible flashlight 81 is a part of flashlight module 12. Infrared laser assembly 28 and visible laser assembly 27 are housed within laser module 10. While these are preferred positions, other variations and permutations are possible. For example, the infrared flashlight 29 could be located within flashlight module 12.

Laser assemblies 27 and 28 are adjusted using adjustments screws 26 and 30, respectively. Preferably, these screws adjust the lasers as previously disclosed by the inventor in prior applications. The preferred parts list and necessary electrical connections have also been previously described in great detail in the prior application.

Referring now to FIGS. 3, 3A through 3*c*, interface chassis 23 is shown with the associated leveling parts that enable the invention to be moved easily from weapon to weapon without the need for adjusting the sighting. The geometry of chassis 23 will change in accordance with the particular weapon that the chassis is installed on. However, the leveling assembly 84 are the same on every chassis 23, regardless of the weapon that it is installed on. In this manner, laser module apparatus 10 can be easily moved from weapon to weapon without the need for field adjustments in order to sight the weapon properly.

Locking bolt 20 secures chassis onto the weapon, in this case, pistol 24. Locking bolt 20 is screwed into a threaded opening that is already present in pistol 24, in this case, an H & K 9 mm, specially designed offensive handgun. For use with handguns not having this connection, it can be easily added to the weapon trigger guard.

Machined into chassis 23 are counterbores 54 and 55. Counterbores 54 and 55 are round. Preferably, the diameter of these counterbores is approximately ⅝ of inch. Subplate 25 is machined to have counterbores that correspond to counterbores 54 and 55, that is 54' and 55'. Counterbore 54' is substantially identical to counterbore 54. However, counterbore 55' is oval to permit side to side movement. Rubber washers 31 are selected to fit into counterbores 54, 54', 55, and 55'. O-ring 32 is selected to fit into groove 56 and groove 58. Groove 56 is machined into chassis 23 and groove 58 in subplate 25.

Leveling assembly 84 is held together via bolts 33 which are screwed into holes 64. Section 86 is the pivot point for the windage adjustment. Section 88 allows subplate 25 to move left to right to correct for windage. Adjustment screw 21 urges against tab 70, causing subplate 25 to move either left or right. Counterbore 55' and the corresponding slot 90 is oval to permit subplate 25 to easily slide relative to chassis 23.

To adjust elevation upward, screw in rear adjustment screws 22, wherein screws 22 are urged against adjustment plates 74. In turn, adjustment plates 74 compresses O-ring 32. Note that grooves 56 and 58 have a 45 degree shoulder which transforms the compressing into a vertical adjustment. To adjust the elevation downward, screw in forward adjustment screws 22.

To remove laser module 10 from subplate 25, the operator depresses release levers 19 and slides module 10 along dovetail 92. Levers 19 are locked around posts 76, held in place via spring 78.

Figure 5:
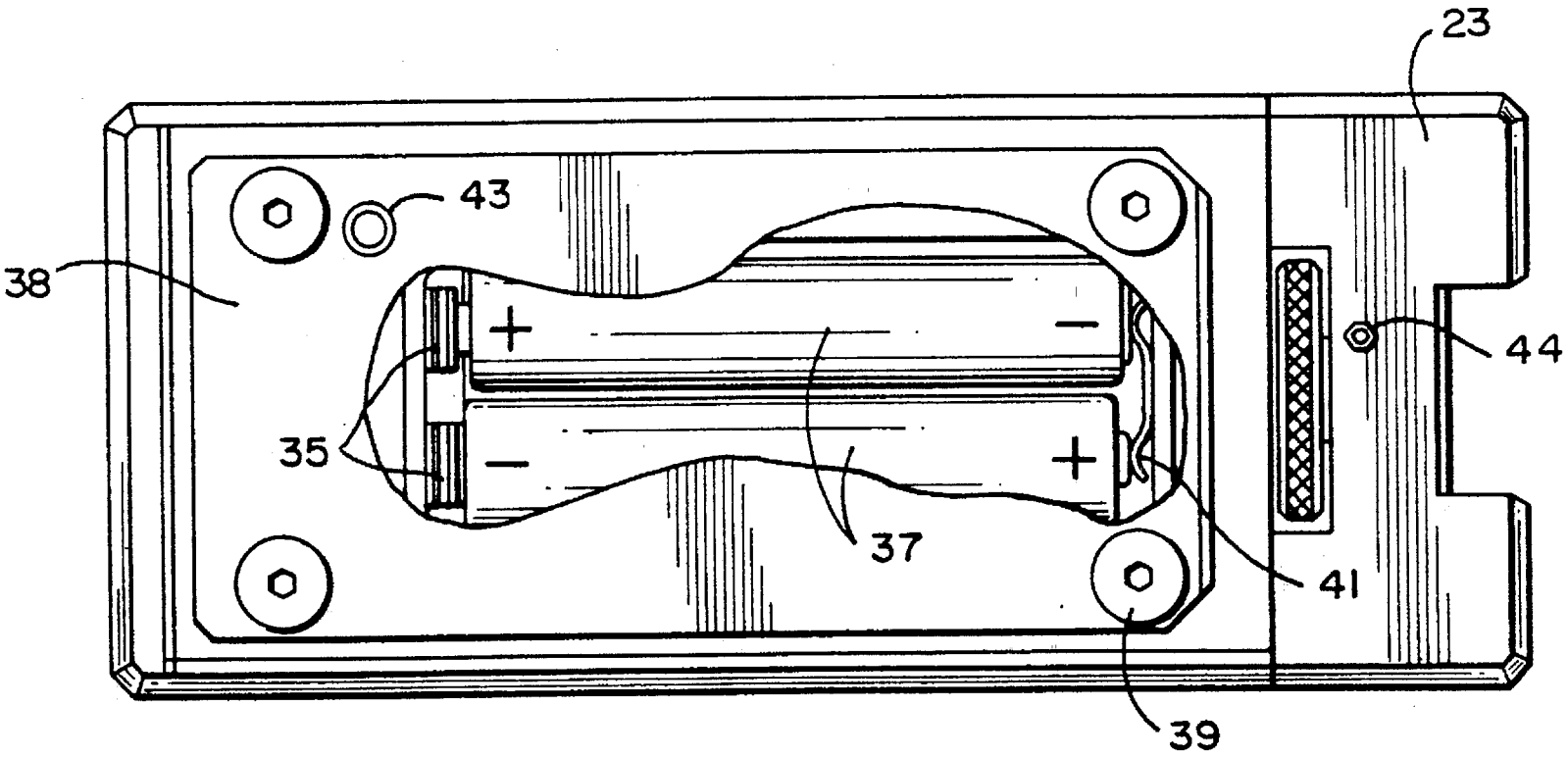
FIG. 5 is a partial cut-away bottom view of the battery compartment of the modular laser apparatus along section line CC of FIG. 1.

Referring to FIG. 5, infrared emitter 43 in laser module 10 communicates with an infrared detector (not shown) in flashlight module 12 which activates flashlight module 12.

Figure 7:
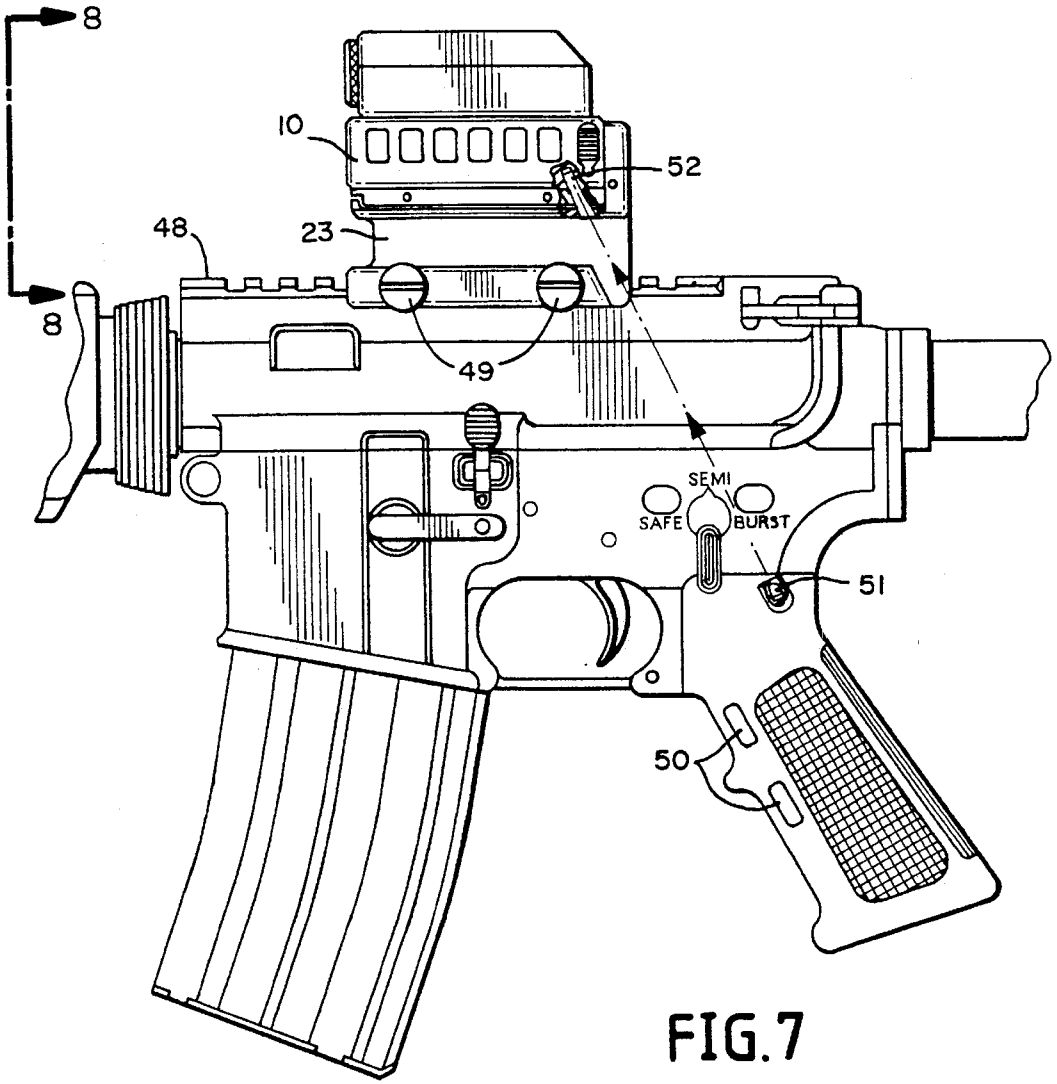
FIG. 7 is a side view of the modular laser apparatus mounted on a typical rifle.
Figure 8:
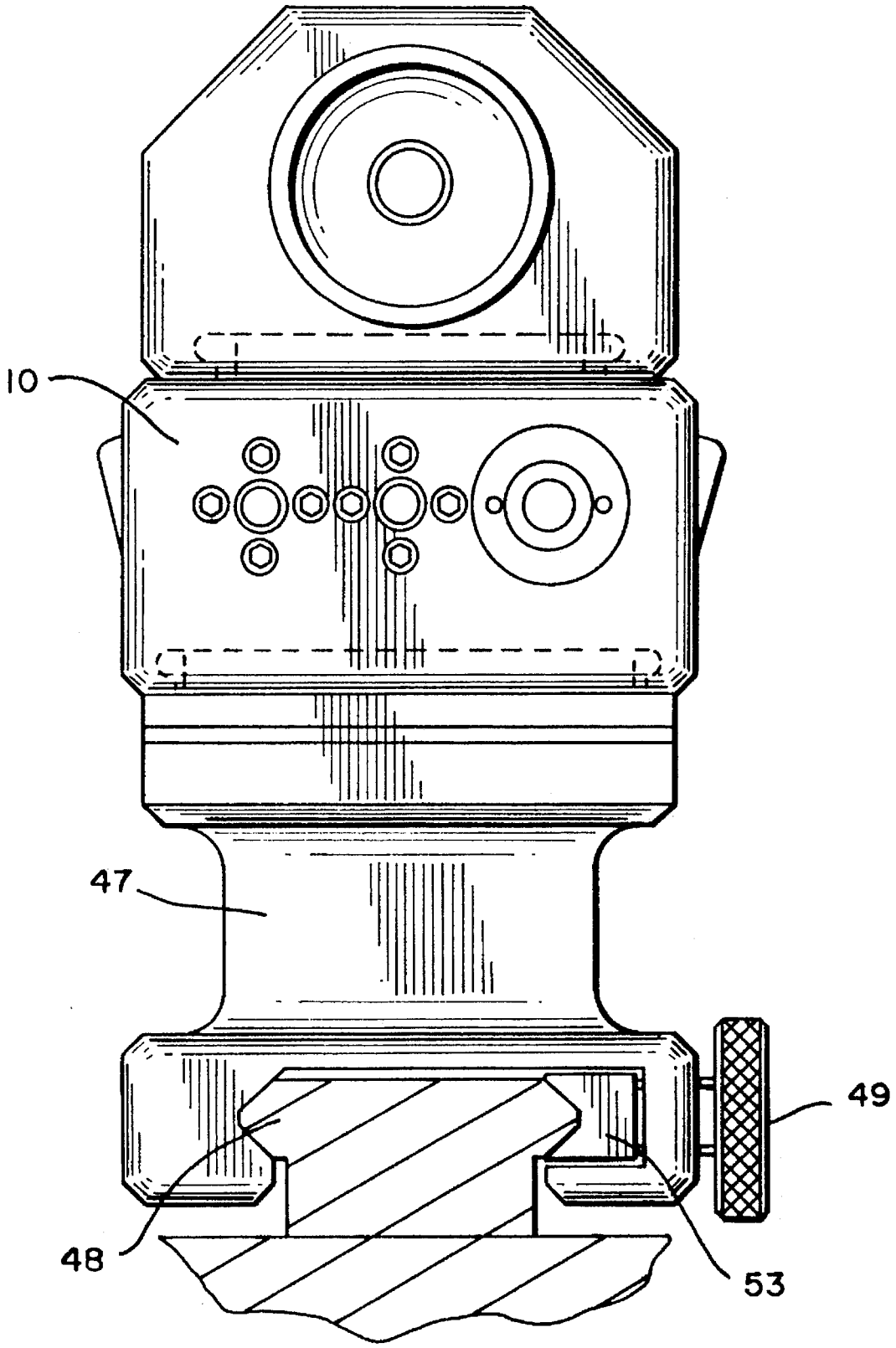
FIG. 8 is a front view of the modular laser apparatus along section line DD of FIG. 7.

FIG. 7 is a side view of the modular laser apparatus mounted on a typical rifle. In this variation, chassis 23' has been modified to fit the weapon. As previously discussed, only the external geometry of chassis 23' has changed, the adjustment mechanism is identical. Rather than the pressure pad 46 of FIG. 6, infrared emitter 51 is located in the grip of the weapon which communicates with an infrared detector 52 in laser module 10. In this case, chassis 23' attaches to the weapon via thumbscrews 49 which engage picatinny rail 48. A detail of the attachment is shown in FIG. 8.

Figure 9:
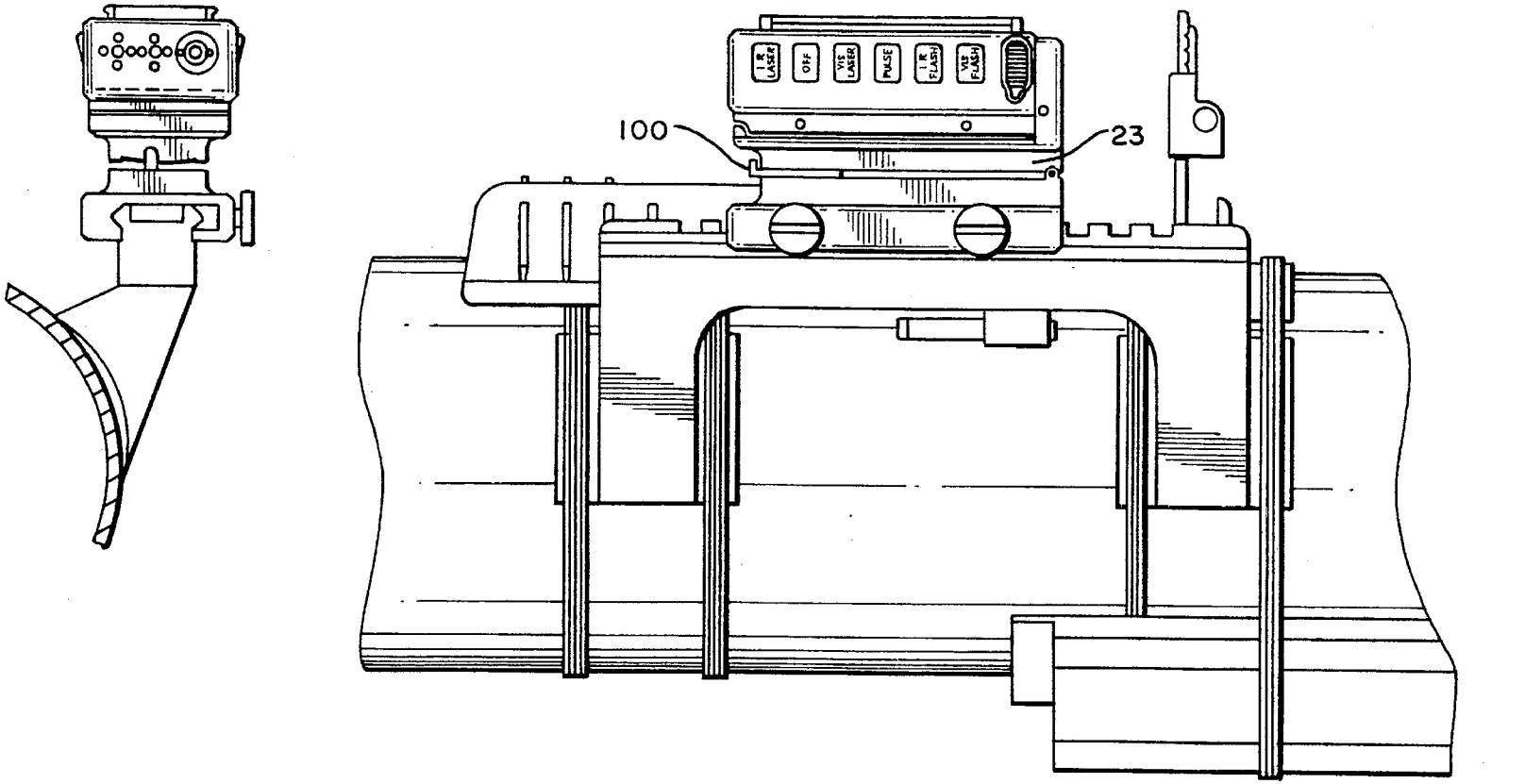
FIG. 9 is a side view of the modular laser apparatus mounted on an SMAW-D.

FIG. 9 shows laser module 10 attached SMAW/D weapon. As with the rifle connection, a picatinny rail attachment mechanism is used. Chassis 23" can be fitted with an optional hinged arrangement 100 to permit laser module 10 to be adjustment for gross elevation adjustments.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A sight apparatus for a firearm comprising:

a chassis mountable on said firearm;

an adjustable subplate mounted to said chassis;

a laser module, releasably attachable to said chassis and said adjustable subplate, said laser module having a front face with at least one laser device able to emit a laser beam, said device being housed within said laser module, with the laser beam from said laser device exiting the front face of said laser module;

said subplate further comprising an adjustment mechanism for aligning said laser module with said firearm, such that the laser beam of said laser device will then accurately sight on an intended target of said firearm;

a flashlight module, releasably attachable to said laser module, said flashlight module having a front face with at least one light source able to emit a light beam, said light source housed within said flashlight module, with the light beam from said light source exiting the front face of said flashlight module.

2. The sight apparatus of claim 1, wherein said laser module further comprises a keypad having a plurality of buttons for controlling said laser module.

3. The sight apparatus of claim 2, wherein said keypad further comprises at least one button for controlling said flashlight module.

4. The sight apparatus of claim 3, wherein said plurality of buttons comprises a button to select a visible laser, a button to select an infrared laser, a button to select a visible light source from said flashlight module, a button to select an infrared light source from said flashlight module, a button to select the use of both said laser module and said flashlight module simultaneously, and a button to select a laser pulse rate for said laser module.

5. The sight apparatus of claim 4 with said firearm having a trigger guard wherein said laser module is activated by a pressure pad located below the trigger guard of said firearm.

6. The sight apparatus of claim 4 with said firearm having hand grips wherein said laser module is activated by at least one activation button on one of the hand grips of said firearm.

* * * * *